US007896464B2

(12) United States Patent
Long et al.

(10) Patent No.: US 7,896,464 B2
(45) Date of Patent: Mar. 1, 2011

(54) PRINTHEAD RESTRAINT SYSTEM

(75) Inventors: Ethan Russell Long, Beaverton, OR (US); Brian G. Russell, Portland, OR (US)

(73) Assignee: Xerox Corporation, Norwalk, CT (US)

( * ) Notice: Subject to any disclaimer, the term of this patent is extended or adjusted under 35 U.S.C. 154(b) by 78 days.

(21) Appl. No.: 12/408,764

(22) Filed: Mar. 23, 2009

(65) Prior Publication Data

US 2010/0238235 A1 Sep. 23, 2010

(51) Int. Cl.
*B41J 2/045* (2006.01)

(52) U.S. Cl. ..... 347/37

(58) Field of Classification Search ..... None
See application file for complete search history.

(56) References Cited

U.S. PATENT DOCUMENTS 6,669,383 B2 * 12/2003 Ansell et al. ..... 400/283
6,846,060 B2 * 1/2005 Waller et al. ..... 347/22
7,344,324 B2 * 3/2008 Sawai ..... 400/120.16

* cited by examiner

*Primary Examiner*—Matthew Luu
*Assistant Examiner*—Alejandro Valencia
(74) *Attorney, Agent, or Firm*—Maginot, Moore & Beck LLP

(57) ABSTRACT

A system for restraining printhead movement in an imaging device includes an imaging device frame; a carriage operably coupled to the imaging device frame for movement between a print position and a retracted position; and a printhead array movably supported by the carriage for translation with respect to the carriage. The system includes a restraint system supported by the carriage. The restraint system has at least one carriage restraint pin and a printhead restraint pin. The at least one carriage restraint pin is configured for movement into and out of engagement with the imaging device frame and the printhead restraint pin being configured for movement into and out of engagement with the printhead array when the carriage is at the retracted position.

11 Claims, 7 Drawing Sheets

PRINTHEAD RESTRAINT SYSTEM

TECHNICAL FIELD

The present disclosure relates to imaging devices that utilize printheads to form images on media, and, in particular, to printhead restraints for use in such imaging devices.

BACKGROUND

Ink jet printing involves ejecting ink droplets from orifices in a printhead onto an image receiving surface to form an image. Ink-jet printing systems commonly utilize either direct printing or offset printing architecture. In a typical direct printing system, the image receiving surface comprises a media substrate and ink is ejected from jets in the printhead directly onto the media substrate. In an offset printing system, the image receiving surface comprises an intermediate transfer surface, such as a drum or belt, and ink is ejected by the jets of the printhead onto an intermediate transfer surface, such as a liquid layer on a drum. The final receiving substrate is then brought into contact with the intermediate transfer surface and the ink image is transferred and fused or fixed to the substrate.

In many direct and offset printing systems, the printhead(s) are configured for movement with respect to the image receiving surface. For example, printheads may also be configured to translate across the image receiving surface as the printhead while forming images on the image receiving surface. Printheads may be also configured for movement toward and away from the image receiving surface to, for example, enable maintenance operations. When moving or transporting an imaging device that includes movable printheads, printhead movement is advantageously restrained or prevented so that the printheads of the imaging device are protected from inadvertent contact with other internal components of the imaging device should the imaging device experience a shock loading or other deleterious movement during transport.

Previously known printers featured a single printhead that performed a shorter range of movements. In such previously known devices, printhead restraint was enabled by bringing mechanized components in the printer into contact with the printhead. Current imaging devices, however, may include multiple printheads that are configured for a more extensive range of movements than previously known printers. Restraining the printheads in a multi-printhead system with an extensive range of printhead movement is difficult without creating interferences with the printhead range of movement and/or without increasing the cost and complexity of the restraint system.

SUMMARY

The present disclosure is directed to a printhead restraining system that is configured to lock or restrain both head-to-drum (HTD) movement and translational movement of a printhead or printhead array in an imaging device that incorporates one or more printheads or printhead arrays. In one embodiment, a system for restraining printhead movement in an imaging device includes an imaging device frame; a carriage operably coupled to the imaging device frame for movement between a print position and a retracted position; and a printhead array movably supported by the carriage for translation with respect to the carriage. The system includes a restraint system supported by the carriage. The restraint system has at least one carriage restraint pin and a printhead restraint pin. The at least one carriage restraint pin is configured for movement into and out of engagement with the imaging device frame and the printhead restraint pin being configured for movement into and out of engagement with the printhead array when the carriage is at the retracted position.

In another embodiment, an imaging device is provided that includes an imaging device frame, and an image receiving surface supported by the imaging device frame for movement in a process direction. A plurality of carriages is operably coupled to the imaging device frame. Each carriage in the plurality is configured for movement toward and away from the image receiving surface between a print position and a retracted position. A printhead array is movably supported by each carriage in the plurality for translation in a cross-process direction with respect to the image receiving surface. A restraint system is supported by each carriage in the plurality. Each restraint system includes at least one carriage restraint pin and a printhead restraint pin. The at least one carriage restraint pin is configured for movement into and out of engagement with the imaging device frame and the printhead restraint pin is configured for movement into and out of engagement with the associated printhead array when the corresponding carriage is at the retracted position.

In yet another embodiment, a method of restraining printheads of an imaging device that includes a frame that supports an image receiving surface and a plurality of carriages, each carriage configured for head-to-drum (HTD) movement with respect to the image receiving surface. Each carriage supports at least one printhead in a manner that enables the at least one printhead to be translated in a cross-process direction with respect to the image receiving surface. The method includes providing a restraint system in each carriage of the imaging device. The restraint systems each include a carriage restraint pin and a printhead restraint pin. To restrain the printhead, each carriage is moved to a restraint position. With the carriages at the restraint positions, the restraint systems are actuated in each carriage to move the corresponding carriage restraint pin into engagement with the frame to prevent HTD movement of the corresponding carriage and to move the corresponding printhead restraint pin into engagement with the at least one printhead supported on the carriage to prevent translation of the at least one printhead with respect to the carriage.

DETAILED DESCRIPTION

Figure 1:
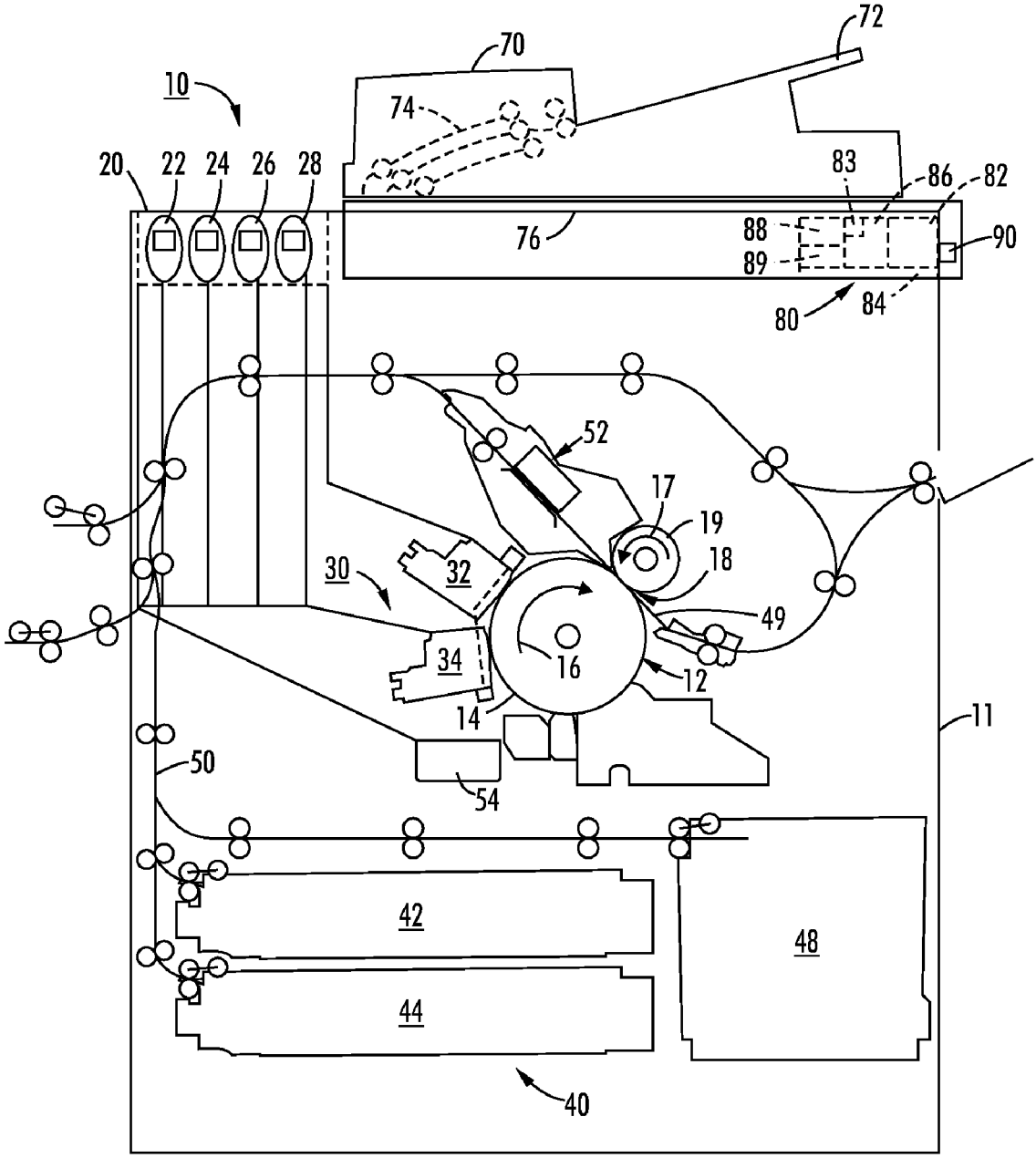
FIG. 1 is a schematic elevational view of an embodiment of an imaging device.

For a general understanding of the present embodiments, reference is made to the drawings. In the drawings, like reference numerals have been used throughout to designate like elements.

As used herein, the terms "printer" or "imaging device" generally refer to a device for applying an image to print media and may encompass any apparatus, such as a digital copier, bookmaking machine, facsimile machine, multi-function machine, etc. which performs a print outputting function for any purpose. "Print media" can be a physical sheet of paper, plastic, or other suitable physical print media substrate for images, whether precut or web fed. The imaging device may include a variety of other components, such as finishers, paper feeders, and the like, and may be embodied as a copier, printer, or a multifunction machine. A "print job" or "document" is normally a set of related sheets, usually one or more collated copy sets copied from a set of original print job sheets or electronic document page images, from a particular user, or otherwise related. An image generally may include information in electronic form which is to be rendered on the print media by the marking engine and may include text, graphics, pictures, and the like.

Referring now to FIG. 1, an embodiment of an imaging device 10 of the present disclosure, is depicted. As illustrated, the device 10 includes a frame 11 to which are mounted directly or indirectly all its operating subsystems and components, as described below. In the embodiment of FIG. 1, imaging device 10 is an indirect marking device that includes an intermediate imaging member 12 that is shown in the form of a drum, but can equally be in the form of a supported endless belt. The imaging member 12 has an image receiving surface 14 that is movable in a process (Y-axis) direction 16 past a printhead system 30. The printhead system 30 is configured to form an image on the image receiving surface of the drum as the drum rotates in the process direction. A transfix roller 19 rotatable in the direction 17 is loaded against the surface 14 of drum 12 to form a transfix nip 18, within which ink images formed on the surface 14 are transfixed onto a media sheet 49. In alternative embodiments, the imaging device may be a direct marking device in which the ink images are formed directly onto a receiving substrate such as a media sheet or a continuous web of media. The terms "Y-axis" and "process direction" may be used interchangeably and refer to an axis or direction that is parallel to the direction of movement of an image receiving surface past a printhead, and the terms "X-axis" and "cross-process direction" may be used interchangeably and refer to an axis or direction that is perpendicular to the process direction.

The imaging device 10 includes an ink delivery subsystem 20 that has at least one source 22 of one color of ink. Since the imaging device 10 is a multicolor image producing machine, the ink delivery system 20 includes four (4) sources 22, 24, 26, 28, representing four (4) different colors CYMK (cyan, yellow, magenta, black) of ink. In one embodiment, the ink utilized in the imaging device 10 is a "phase-change ink," by which is meant that the ink is substantially solid at room temperature and substantially liquid when heated to a phase change ink melting temperature for jetting onto an imaging receiving surface. Accordingly, the ink delivery system includes a phase change ink melting and control apparatus (not shown) for melting or phase changing the solid form of the phase change ink into a liquid form. The phase change ink melting temperature may be any temperature that is capable of melting solid phase change ink into liquid or molten form. In one embodiment, the phase change ink melting temperate is approximately 100° C. to 140° C. In alternative embodiments, however, any suitable marking material or ink may be used including, for example, aqueous ink, oil-based ink, UV curable ink, or the like.

The ink delivery system is configured to supply ink in liquid form to a printhead system 30 including at least one printhead assembly. In the embodiment of FIG. 1, the printhead system 30 includes two printhead assemblies 32, 34 although the imaging device may include any suitable number of printhead assemblies. Each printhead assembly includes at least one printhead arrayed across the image receiving surface in the cross-process direction (i.e., along the X-axis). The printheads in a printhead array may be spaced from each other in the cross-process direction or butted together to form a continuous linear array.

As further shown, the imaging device 10 includes a media supply and handling system 40. The media supply and handling system 40, for example, may include sheet or substrate supply sources 42, 44, 48, of which supply source 48, for example, is a high capacity paper supply or feeder for storing and supplying image receiving substrates in the form of cut sheets 49, for example. The substrate supply and handling system 40 also includes a substrate or sheet heater or preheater assembly 52. The imaging device 10 as shown may also include an original document feeder 70 that has a document holding tray 72, document sheet feeding and retrieval devices 74, and a document exposure and scanning system 76.

Operation and control of the various subsystems, components and functions of the machine or printer 10 are performed with the aid of a controller or electronic subsystem (ESS) 80. The ESS or controller 80 for example is a self-contained, dedicated mini-computer having a central processor unit (CPU) 82, electronic storage 84, and a display or user interface (UI) 86. The ESS or controller 80 for example includes a sensor input and control system 88 as well as a pixel placement and control system 89. In addition the CPU 82 reads, captures, prepares and manages the image data flow between image input sources such as the scanning system 76, or an online or a work station connection 90, and the printhead arrays 32, 34. As such, the ESS or controller 80 is the main multi-tasking processor for operating and controlling all of the other machine subsystems and functions, including the printhead cleaning apparatus and method discussed below.

In operation, image data for an image to be produced are sent to the controller 80 from either the scanning system 76 or via the online or work station connection 90 for processing and output to the printhead arrays 32, 34. Additionally, the controller determines and/or accepts related subsystem and component controls, for example, from operator inputs via the user interface 86, and accordingly executes such controls. As a result, appropriate color solid forms of phase change ink are melted and delivered to the printhead assemblies. Additionally, pixel placement control is exercised relative to the imaging surface 14 thus forming desired images per such image data, and receiving substrates are supplied by any one of the sources 42, 44, 48 along supply path 50 in timed registration with image formation on the surface 14. Finally, the image is transferred from the surface 14 and fixedly fused to the copy sheet within the transfix nip 18.

Figure 2:
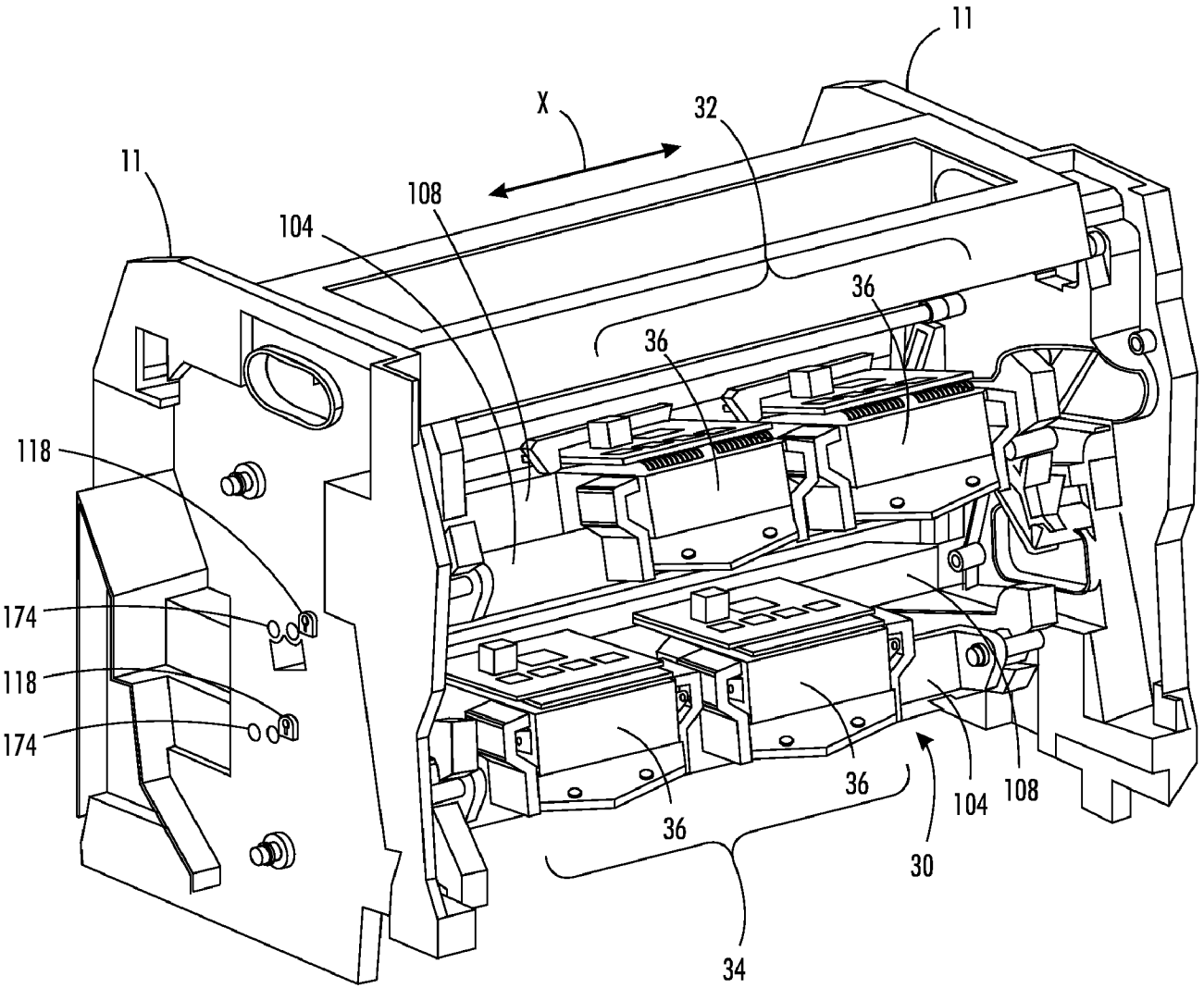
FIG. 2 is a perspective view of the arrangement of printheads in the imaging device of FIG. 1.

Referring now to FIG. 2, a more detailed view of the printhead system 30 of FIG. 1 is shown. As depicted in FIG. 2, the printhead system 30 includes two printhead arrays 32, 34 with each printhead array having two printheads 36. In the embodiment of FIG. 2, each printhead array 32, 34, comprises a Staggered Full Width Array (SFWA) in which the printheads 36 of an array are spaced from each other in the cross-process direction. While forming an image, a mode referred to herein as print mode, the upper printhead array 32 and the lower printhead array 34 are staggered with respect to each other in the cross-process direction to enable the printhead system 30 to form an image across the full cross-process direction width of the image receiving surface. Each printhead array 32, 34 is mounted to a printhead array frame 104 that is movably supported by a carriage 108, as depicted in FIG. 2. Each printhead array frame 104 is configured for cross-process (or X-axis) translation of the printhead array with respect to the carriage 108 and, consequently, the image receiving surface. Printhead array frames 104 may be operably coupled to a carriage 108 in any suitable manner that permits the requisite translational movement of the printhead array frame.

Figure 3:
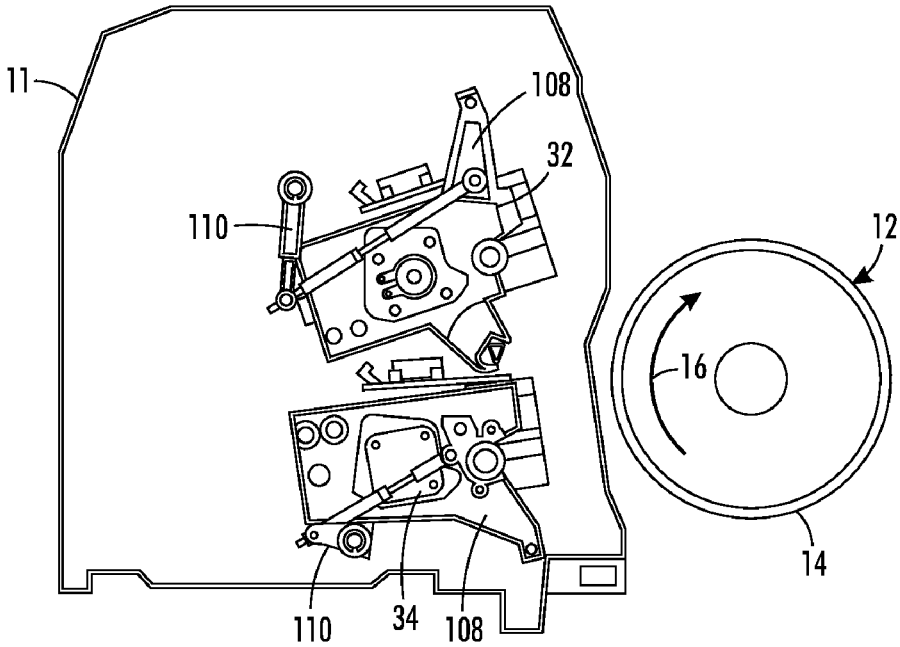
FIG. 3 is a side view of the printheads of FIG. 2 in a retracted position.
Figure 4:
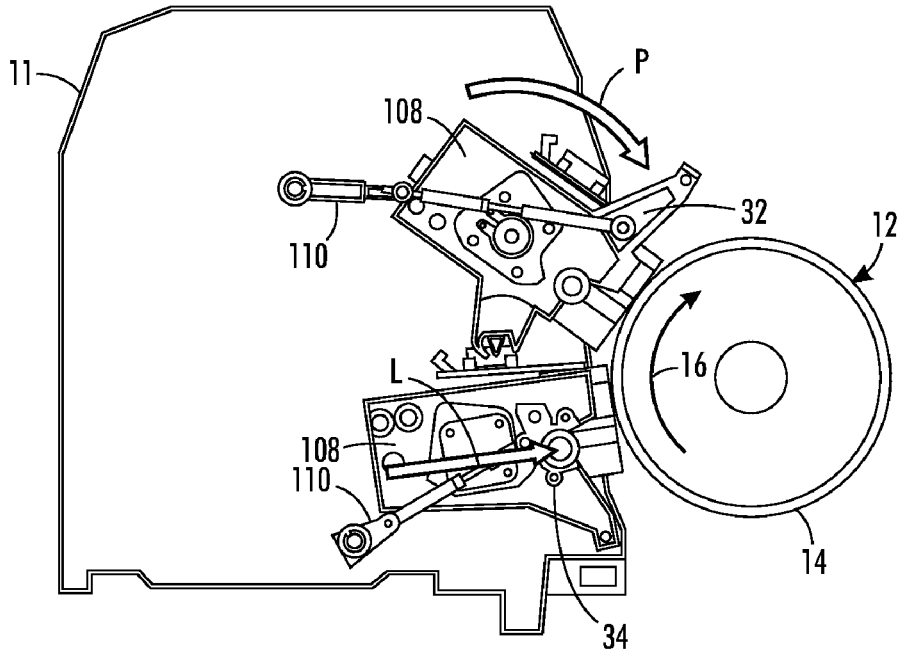
FIG. 4 is a side view of the printheads of FIG. 2 in a home/print position.
Figure 5:
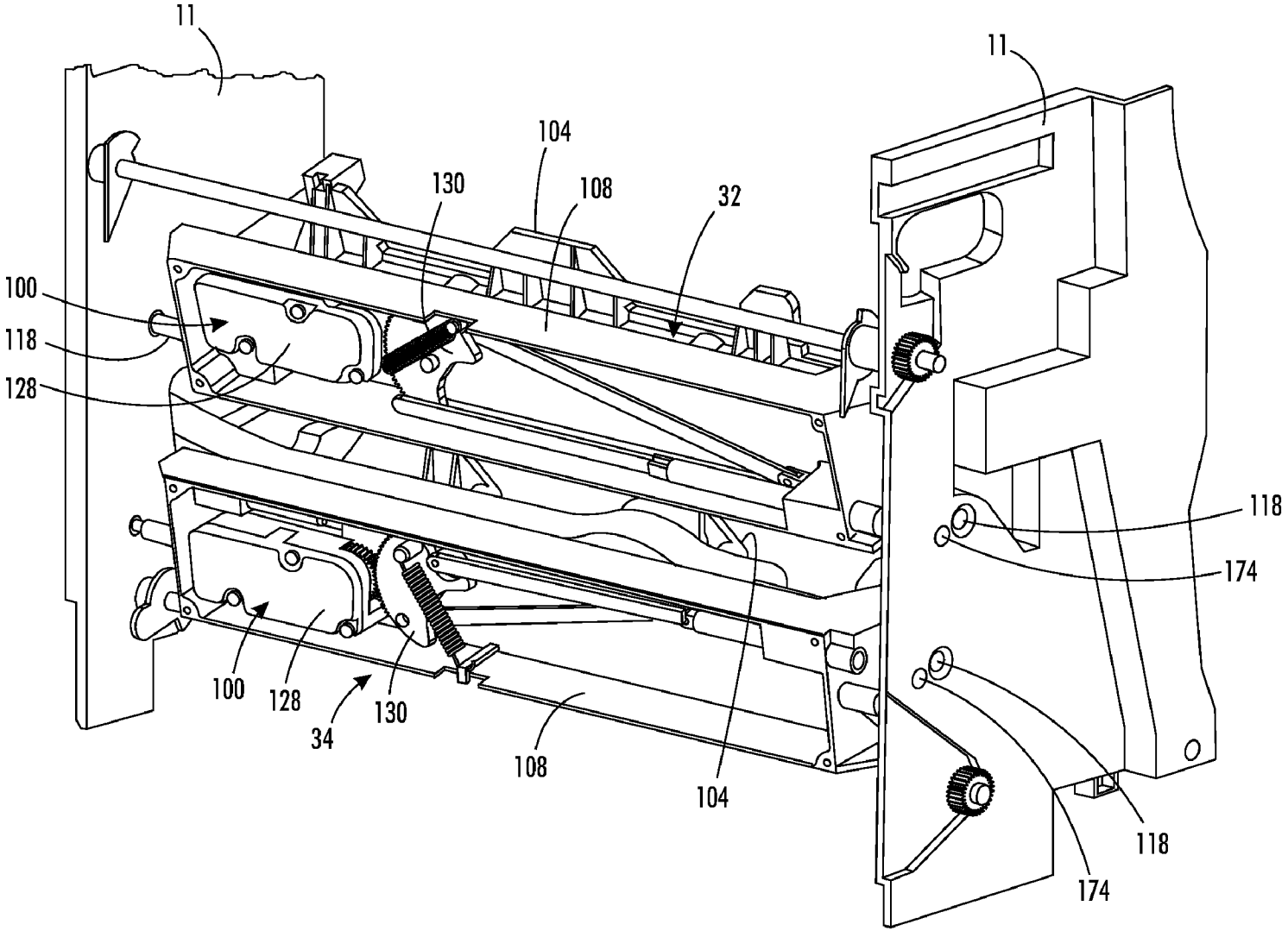
FIG. 5 is a perspective view of the printhead carriages of the imaging device showing the printhead restraint systems.

Each carriage 108 is movably supported in the imaging device so that the corresponding printhead array 32, 34 may be moved into various positions with respect to the drum, referred to herein as Head to Drum (HTD) movement. In an exemplary embodiment, the different positions to which an printhead array 32, 34 may be moved include at least one retracted position in which the printhead array 32, 34 is retracted from the drum (FIG. 3) and a home/print position in which the printhead array 32, 34 is positioned closely adjacent the drum (FIG. 4). HTD movement of a carriage between the various positions may be accomplished in any suitable manner. For example, carriages 108 may be configured for linear, pivotal, or a combination of linear and pivotal movement toward and away from the drum. In the embodiment of FIGS. 3 and 4, the upper printhead array 32 is configured for pivotal movement along a path P within the imaging device and the lower printhead array 34 is configured for linear movement along a path L within the imaging device.

Each printhead array 32, 34 is operably coupled to a suitable positioning system 110 that is configured to actuate and control the X-axis movement of the printhead array frame 104 with respect to the carriage 108 and to actuate and control the HTD movement of the carriage 108 between the various positions (FIGS. 3 and 4). The positioning systems 110 may be under the control of controller 80, and may include any necessary drivers, motors, pistons, sensors, and the like that enables the controller to drive and track the lateral (X-axis) movement of the printhead array frame with respect to the carriage and the HTD movement of the carriage assemblies with respect to the drum.

When moving or transporting an imaging device, such as the imaging device described above, printhead movement is advantageously restrained or prevented so that the printheads of the imaging device are protected from inadvertent contact with other internal components of the imaging device should the imaging device experience a shock loading or other deleterious movement during transport. Accordingly, the present disclosure proposes a printhead restraint system that includes a separate restraint system 100 housed in each printhead carriage 108 in the imaging device. Each restraint mechanism is configured to a) lock printhead array (SFWA) movement with respect to the carriage (the "X-direction"), and b) lock the movement of the entire carriage assembly against motion toward the fragile imaging drum surface. As explained below, the restraint systems are equipped with pins that lock into the imaging device side frames to prevent HTD movement. Additionally, each restraint mechanism pushes a printhead array restraint pin into the printhead array frame to lock it to the carriage. This restraint design is advantageous to a multi-head product because it is compact enough to fit within a printhead array carriage assembly and, when retracted, it will not interfere with the motion of the carriage or other marking unit systems. Since each printhead array carriage is equipped with a restraint mechanism, a head restraint solution is in place regardless of how many carriages are used in a product.

To facilitate the restraint locking function, each of the printhead carriages 108 is first moved to a predetermined restraint position, also referred to herein as a ship or shipping position. In one embodiment, a restraint position corresponds to the retracted position of the carriage assemblies depicted in FIG. 3. A restraint position, however, may be substantially any position along the respective carriages path of movement. For example, the restraint position may be any position between and including the home/print position depicted in FIG. 4 and the retracted position depicted in FIG. 3. Each printhead array frame 104 mounted on a carriage 108 may also be moved laterally (X-axis) with respect to the carriage 108 to a predetermined restraint position at which the printhead array is locked to prevent lateral movement of the printhead array with respect to the carriage. The carriages 108 and printhead array frames 104 may be moved to the restraint position in response to input received by the controller 80 through, for example, the user interface of the imaging device. The controller 80 may actuate the positioning system 110 of the carriages 108 in a known manner to move each carriage and corresponding printhead array 32, 34 to its respective restraint position.

Figure 6:
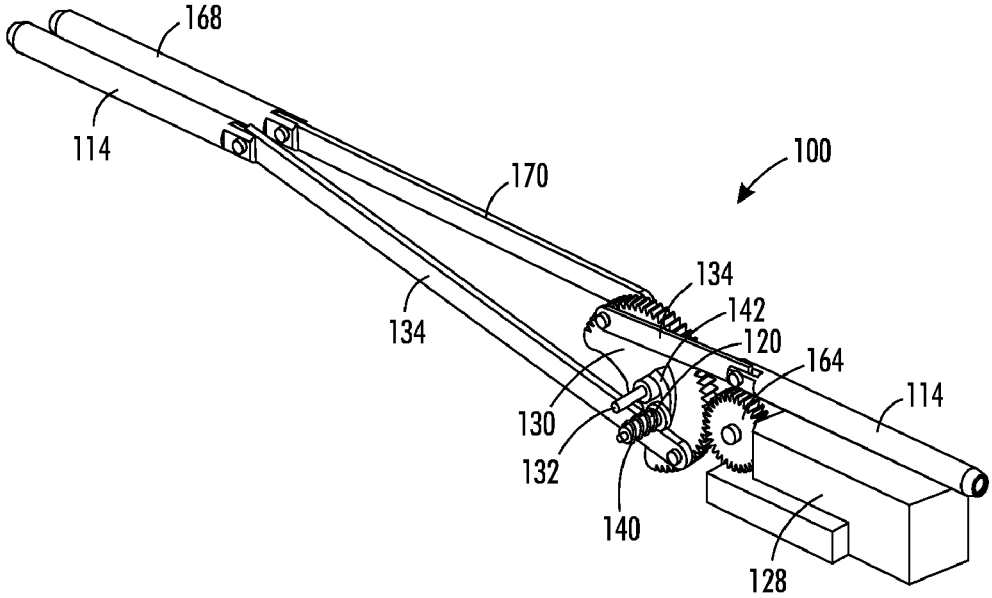
FIG. 6 is a perspective view of the restraint system of FIG. 5 in the disengaged position.
Figure 7:
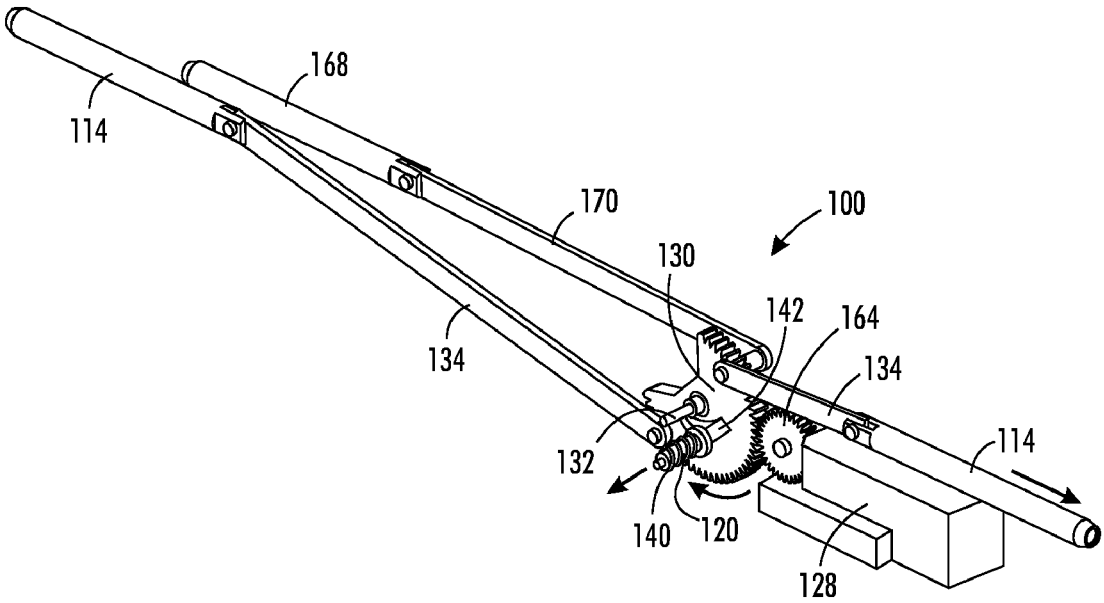
FIG. 7 is a perspective view of the restraint system of FIG. 5 in the engaged position.

Referring now to FIGS. 5 to 10, the restraint system 100 in each carriage 108 includes at least one HTD locking pin 114 that is configured to extend out from the carriage 108 when the carriage is in the restraint position to engage features in the imaging device frame in order to effectively "lock" the carriage at the restraint position. As best seen in FIGS. 6 and 7, a restraint system 100 may include two HTD locking pins 114 that are configured to extend laterally from each end of a carriage 108. In one embodiment, each HTD locking pin 114 is supported in the corresponding carriage for translation between a disengaged position at which the HTD locking pins 114 are retracted (FIG. 6) and held within the confines of the carriage (not shown in FIG. 6) and an engaged or locking position at which the HTD locking pins 114 are extended (FIG. 7) beyond the lateral ends of the carriage (not shown in FIG. 6). When in the restraint position, the HTD locking pins 114 are positioned to engage, for example, openings 118 in complementary positions in the imaging device frame 11.

Figure 10:
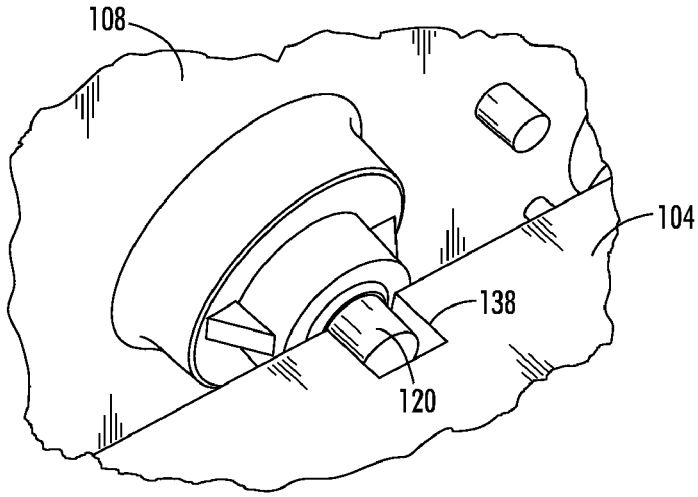
FIG. 10 is a perspective view of the printhead array locking pin of the restraint system engaged with a printhead array frame.

In addition to the HTD locking pins 114, each restraint system includes an array locking pin 120. The array locking pin 120 is supported in the corresponding carriage 108 for translation in a direction from the back of the carriage toward the printhead array mounted at the front of the carriage. The array locking pin 120 is supported for movement between a disengaged position at which the printhead array restraint pin is retracted away from the printhead array (FIG. 6) and an engaged or locking position at which the printhead array restraint pin 120 is extended or pushed through an opening 124 in the carriage 108 toward the printhead array frame 104 (FIGS. 7 and 10). With the printhead array frame 104 in a restraint position with respect to the carriage 108, the printhead array restraint pin 120 is aligned with a complementarily shaped feature 138 in the printhead array frame 104. When the printhead array restraint pin 120 translated into its locking position and the pin is pushed through the opening in the carriage, the restraint pin 120 engages the complementary feature 138 in the printhead array 104 thereby preventing lateral movement of the printhead array 104 with respect to the carriage.

Each restraint system 100 includes a driver that is configured to move the HTD 114 and array restraint pins 120 from their disengaged positions to their locking positions. Any suitable driving system may be utilized. In one embodiment, the locking pin drive system includes a linkage assembly 130 and a linkage driver 128. The linkage assembly 130 is operably coupled to the locking pins 114, 120 in a manner such that movement of the linkage assembly imparts the translational movement to the locking pins. The linkage driver 128, in turn, is operably coupled to the linkage assembly 130 and is configured to impart the movement to the linkage assembly 130 that causes the locking pins 114, 120 to be moved between the disengaged positions and the locking positions.

The exemplary linkage assembly 130 of FIGS. 5-10 includes a linkage member in the form of a cam gear 130. Cam gear 130 is rotatably supported by a pin 132 extending from the back of the carriage. The cam gear 130 of the linkage assembly is coupled to each HTD locking pin 114 by a linkage arm 134. Linkage arms 134 are freely supported at one end by the corresponding locking pin 114 and at the other end by the cam gear 130, and are attached to the cam gear 130 at predetermined positions along the periphery of the cam gear. Cam gear 130 is configured to rotate about pin 132 between a disengaged position (FIG. 6) and an engaged position (FIG. 7). When in the disengaged position, the HTD restraint pins 114 and the array restraint pin 120 are retracted to their positions within the carriage. As may be ascertained by a person skilled in the art, rotation of the cam gear 130 about pin 132 from the disengaged position to the engaged position causes a corresponding movement of the linkage arms 134 which in turn imparts linear motion to the HTD locking pins 114 to move the HTD locking pins 114 from disengaged positions to locking positions. Conversely, rotation of the cam gear 130 from the engaged position to the disengaged position causes a corresponding movement of the linkage arms 134 which in turn imparts linear motion to the HTD locking pins 114 to move the HTD locking pins 114 from the locking positions to the disengaged positions.

Using the exemplary cam gear linkage 130, motion may be imparted to the array restraint pin 120 using a further cam 142 provided on a side of the cam gear linkage 130. In this embodiment, the array restraint pin 120 is independently supported in an operable position in the carriage frame irrespective of the rotational movement of the cam gear. For example, array restraint pin 120 pin may be sandwiched between the cam gear 130 and the corresponding opening 124 that extends through the carriage 108 toward the printhead array frame 104. Thus, rotation of the cam gear 130 does not affect the lateral position of the restraint pin 120 with respect to the carriage. A spring 140 may be used to bias the pin 120 into the disengaged position. As seen in FIGS. 6 and 7, the further cam 142 may comprise a protrusion from the side of the cam gear 130 in the form of a ramp, for example. The pin 120 and the further cam 142 of the cam gear 130 are positioned with respect to each other such that the further cam 142 is positioned away from the pin 120 when the cam gear 130 is in the disengaged position (FIG. 6). As the cam gear 130 is rotated from the disengaged position to the engaged position (FIG. 7), the protruding cam 142 engages an end of the pin 120. Continued movement of the cam gear causes the protruding cam 142 to move under the pin 120, thereby pushing the pin 120 through the opening 124 in the carriage toward the complementary locking feature 138 in the array frame 104 (FIG. 10). Rotation of the cam gear 130 from the engaged position to the disengaged position removes the further cam 142 from engagement with the pin 120. In the absence of contact with the further cam 142, biasing spring 140 pushes the pin 120 toward the disengaged position (FIG. 6).

Figure 8:
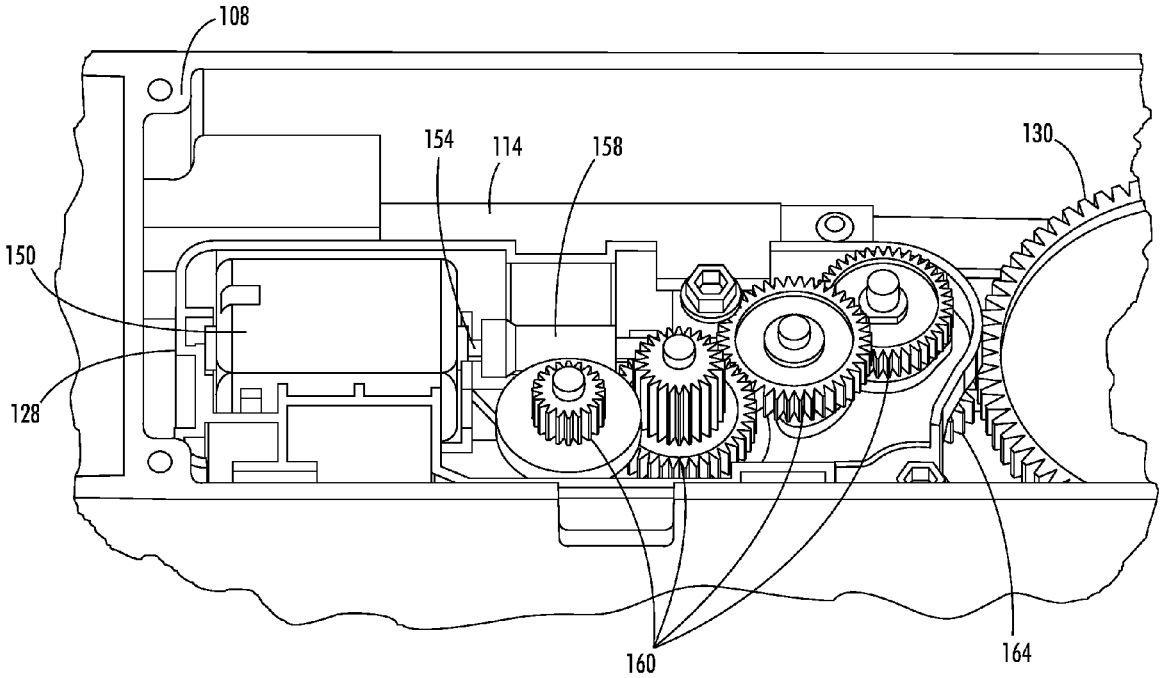
FIG. 8 is a detailed view of the worm drive of the restraint system of FIGS. 6 and 7.

The exemplary cam gear linkage 130 is operably coupled to a suitable linkage driver 128 that is configured to move or rotate the cam gear 130 about the pin 132 between the disengaged and engaged positions. In one embodiment, the linkage drive 128 comprises a worm drive system. With reference to FIG. 8, an exemplary embodiment of a worm drive system 128 is depicted. As shown, the worm drive system includes an electric motor 150 having a motor drive shaft 154, worm 158, gear train 160, and output drive gear 164. The motor 150 may be any suitable type of electric motor, and may be a variable speed motor, a reversible motor, a non-reversible motor, or the like. The motor is operably coupled to a power source (not shown) which, in turn, may be controlled by controller 80 for actuating the motor to engage or disengage the restraint systems. Drive shaft 154 has worm 158 at one end thereof. Gear train 160 includes a plurality of intermeshed gears that are operatively engaged at one end thereof with worm 158 on drive shaft 154 of motor 150 and at the other end with drive gear 164. Drive gear 164 is, in turn, meshed with cam gear linkage 130.

Each restraint system 100 in the imaging device is configured for automatic engagement and disengagement using the corresponding worm drive 128. For example, once a carriage 108 and associated printhead array frame 104 are in their restraint positions, controller 80 may actuate the motor 150 of the worm drive of the corresponding restraint system to rotate drive shaft 154 in a first direction for engaging the restraint system. In response, drive shaft 154 causes worm 158 to rotate. Worm 158 causes rotation of gears 160 of gear train which, in turn, rotates drive gear 164. Drive gear 164 is meshed with cam gear linkage 130 so that rotation of drive gear 164 causes rotation of cam gear linkage 130 from the disengaged position to the engaged position. When it is desired to unlock or unrestrain the printheads, controller 80 actuates the motor 150 to rotate drive shaft in the opposite direction which causes opposite motion of the worm 158, gear train 160, and drive gear 164 which, in turn, causes rotation of cam gear linkage 130 from the engaged position to the disengaged position.

The restraint systems 100 may also be configured for manual engagement and disengagement. For example, referring to FIGS. 6 and 7, a restraint system 100 may be equipped with a manual drive pin 168. In the exemplary embodiment of FIGS. 6 and 7, manual drive pin 168 is supported in the corresponding carriage for translation between a first position (FIG. 6) at which the restraint system 100 is disengaged and a second position (FIG. 7) at which the restraint system is engaged. Manual drive pin 168 is coupled to cam gear linkage 130 by a linkage arm 170. Drive pin linkage arm 170 is attached to the cam gear 130 at a predetermined position along the periphery of the cam gear 130 such that translation of the drive pin 168 from the first position (FIG. 6) to the second position (FIG. 7) causes the cam gear linkage 130 to rotate from the disengaged to the engaged position, which, in turn, causes the restraint pins 114, 120 to be moved to their respective locking positions.

Figure 9:
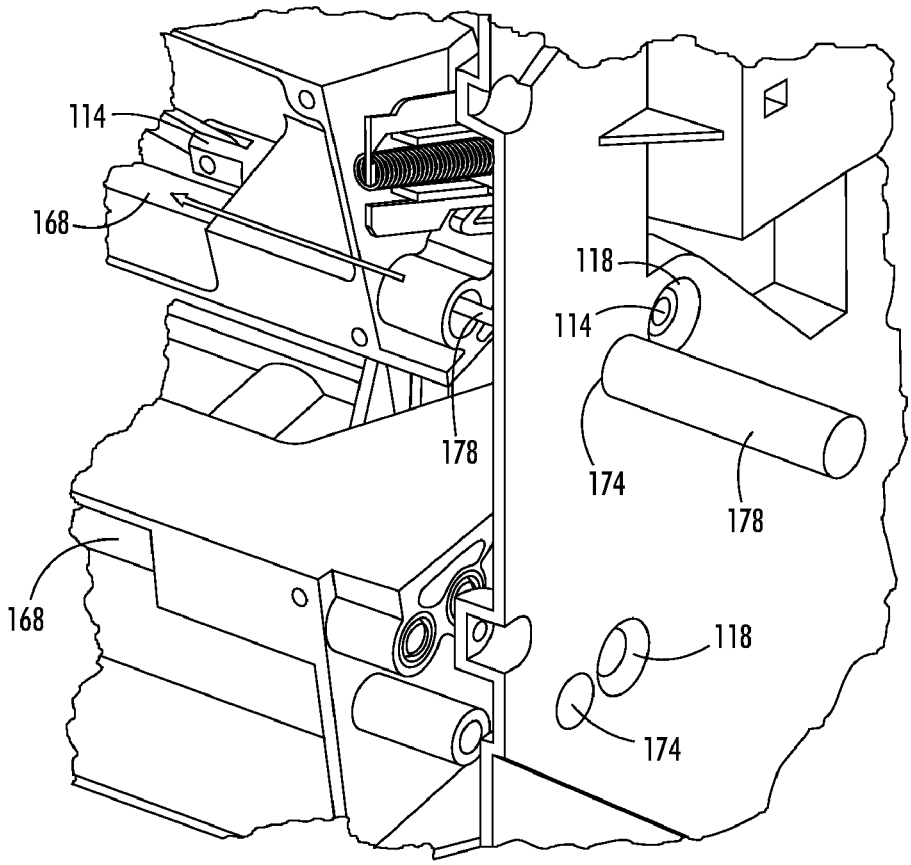
FIG. 9 is a perspective view of the imaging device depicting a slender tool engaging the restraint system of FIGS. 6 and 7.

The drive pin 168 of each restraint system is configured for external access so that the drive pin may be moved from the first position to the second position manually from outside of the imaging device without requiring disassembly of the imaging device. For example, when a carriage 108 is in its restraint position and restraint system 100 is disengaged, an end of manual drive pin 168 is positioned adjacent an access hole 174 in the imaging device. With reference to FIG. 9, for manual engagement, a slender tool 178, such as a rod or screw driver, may be used to push the manual drive pin 168 from the first position to the second position. Manual disengagement may be enabled by providing an access hole 118 in the imaging device to at least one of the HTD restraint pins 114. For manual disengagement, a slender tool may be used to directly push an HTD restraint pin 114 out of its locked position, i.e., from its locked position toward its disengaged position. Movement of the HTD pin 114 from its locked position causes a corresponding movement of cam gear linkage 130 from its engaged position to its disengaged position thereby disengaging the restraint system. The worm drive 128 is an important component in the manual operation of the mechanism. The worm drive is designed with a large enough lead angle so that it may be back-driven from a source external to the worm drive, such as drive pin, while still providing enough frictional resistance to motion that the worm drive holds its position once engaged. The design may therefore utilize the mechanical advantage of a worm drive within its limited design space, and at the same time allow manual operation without disengagement of the drive train.

The printhead restraint system described above may also be utilized to actuate print head thermal insulation covers (not shown). Printhead insulation covers for use with an SFWA printhead array, such as described above, are described in more detail in commonly owned U.S. Publication No. 2006/0227191 to Williams et al. entitled "System and method for insulating solid ink printheads," which is hereby incorporated by reference herein in its entirety. Printhead insulation covers are configured to conserve energy and keep the face plate clean during the printer's sleep mode. Such a cover would need to move out of the way when the head is again needed for printing. Given the printhead restraint's close proximity to the print heads, the restraint system may be modified to perform both head restraint and cover functions using the same mechanism. The restraint mechanism contains both rotational and translational motion components, so a variety of cover actuation schemes are possible. One such arrangement would be a cover that pivots on the print head. In one embodiment, a cable may be extended between the insulative cover and the linkage assembly 130 and running over a guide or pulley. When the shipping restraint is in the engaged position, i.e., sleep mode, the print heads are retracted and the insulative cover is pivoted over the ejecting faces of the printheads. When the printhead restraint is moved from the engaged to the disengaged position, the cable pivots the cover up and out of the way the printheads.

It will be appreciated that various of the above-disclosed and other features and functions, or alternatives thereof, may be desirably combined into many other different systems, applications or methods. Various presently unforeseen or unanticipated alternatives, modifications, variations or improvements therein may be subsequently made by those skilled in the art which are also intended to be encompassed by the following claims.

What is claimed is:

1. An imaging device comprising:

an imaging device frame;

an image receiving surface supported by the imaging device frame for movement in a process direction;

a plurality of carriages operatively connected to the imaging device frame, each carriage in the plurality of carriages being configured to move toward the image receiving surface to a print position and away from the image receiving surface to a retracted position;

a plurality of printhead arrays, each printhead array being movably supported by only one carriage in the plurality of carriages and each carriage in the plurality of carriages supporting only one printhead array, each printhead array being configured for translation in a cross-process direction;

a plurality of restraint systems, each restraint system being supported by only one carriage in the plurality of carriages and each carriage in the plurality of carriages supporting only one restraint system, each restraint system including at least one carriage restraint pin and a printhead restraint pin, the at least one carriage restraint pin being configured for movement into and out of engagement with the imaging device frame to restrain movement of the carriage supporting the restraint system with respect to the imaging device frame and the printhead restraint pin being configured for movement into and out of engagement with the printhead array supported by the carriage to restrain movement of the printhead array with respect to the carriage when the carriage is at the retracted position.

2. The imaging device of claim 1, each restraint system including a driver configured to move the at least one carriage restraint pin into and out of engagement with the imaging device frame to restrain movement of the carriage and the printhead restraint in into and out of engagement with the printhead array to restrain movement of the printhead array.

3. The imaging device of claim 2, the at least one carriage restraint pin and the printhead restraint pin of each restraint system being movably supported by the carriage supporting the restraint system to enable translation into and out of engagement with the imaging device frame and the printhead array supported by the carriage, respectively, when the carriage is at the retracted position; and the driver of each restraint system including a cam gear linkage rotatably supported by the carriage supporting the restraint system, the cam gear linkage being configured to rotate between a disengaged and an engaged position when the carriage is at the retracted position, the at least one carriage restraint pin and the printhead restraint pin being operatively connected to the cam gear linkage to enable the at least one carriage restraint pin and the printhead restraint pin to be disengaged from the imaging device frame and the printhead array, respectively, when the cam gear linkage is at the disengaged position and to be engaged with the imaging device frame and the printhead array, respectively, when the cam gear linkage is at the engaged position.

4. The imaging device of claim 3, each driver further including a worm drive system operatively connected to the cam gear linkage to move the cam gear linkage between the disengaged and engaged positions.

5. The imaging device of claim 4, each worm drive system including an electric motor having a drive shaft, a worm operatively connected to the drive shaft, a worm gear train operatively connected to the worm, and a worm gear drive operatively connecting the worm gear train and the cam gear linkage to enable the cam gear linkage to move from the disengaged to the engaged position in response to rotation of the drive shaft of the motor in a first direction, and to enable the cam gear linkage to move from the engaged to the disengaged position in response to rotation of the drive shaft by the motor in a second direction.

6. The imaging device of claim 5, each restraint system further comprising:

a manual drive pin movably supported by the carriage and configured for translation between a first position and a second position, the manual drive pin being operatively connected to the cam gear linkage to enable movement of the cam gear linkage from the engaged position to the disengaged position in response to the manual drive in moving from the first position to the second position; and the imaging device frame including an access opening that provides external access to the manual drive pin when the carriage is at the retracted position.

7. The imaging device of claim 6, each worm drive system having a lead angle that enables the worm drive to be back driven in response to movement of the manual drive pin from the first to the second position while still providing frictional resistance to motion to maintain the cam gear linkage at the engaged position in the absence of movement of the manual drive pin.

8. The imaging device of claim 7, the image receiving surface comprising a rotating drum.

9. The imaging device of claim 8, the printhead arrays being configured to form images on the drum using melted phase change ink.

10. A method of restraining printheads of an imaging device, the imaging device including a frame that supports an image receiving surface and a plurality of carriages, each carriage configured for head-to-drum (HTD) movement with respect to the image receiving surface, each carriage supporting at least one printhead in a manner that enables the at least one printhead to be translated in a cross-process direction with respect to the image receiving surface, the method comprising:

providing a restraint system in each carriage of the imaging device, the restraint systems each including a carriage restraint pin and a printhead restraint pin;

moving each carriage to a restraint position; and with the carriages at the restraint positions, actuating the restraint system in each carriage to move the corresponding carriage restraint pin into engagement with the frame to prevent HTD movement of the corresponding carriage and to move the corresponding printhead restraint pin into engagement with the at least one printhead supported on the carriage to prevent translation of the at least one printhead with respect to the carriage.

11. The method of claim 10, each restraint system including a worm drive operably coupled to the corresponding carriage restraint pin and the corresponding printhead restraint pin;

the actuation of the restraint system in each carriage further comprising:

actuating the worm drive of each restraint system to move the corresponding carriage restraint pin into engagement with the frame and to move the corresponding printhead restraint pin into engagement with the at least one printhead supported on the carriage.

* * * * *